US006065855A

United States Patent [19]

Hwang

[11] Patent Number: 6,065,855

[45] Date of Patent: May 23, 2000

[54] SAFE SOCKET STRUCTURE USED FOR MINIATURE LIGHT BULBS

[76] Inventor: Min Shien Hwang, No. 2, Lane 65, Chen Kon Road, Hsinchu, Taiwan

[21] Appl. No.: 09/130,364

[22] Filed: Aug. 7, 1998

[51] Int. Cl.[7] ..... F21V 21/00

[52] U.S. Cl. ..... 362/294; 249/806; 249/391

[58] Field of Search ..... 362/294, 249, 362/391, 226, 267; 439/419

[56] References Cited

U.S. PATENT DOCUMENTS 5,681,107 10/1997 Wang ..... 362/391
5,718,504 2/1998 Huang ..... 362/267
5,720,544 2/1998 Shu ..... 362/267
5,738,435 4/1998 Lin et al. ..... 362/267

*Primary Examiner*—Thomas M. Sember
*Attorney, Agent, or Firm*—Rosenberg, Klein & Lee

[57] ABSTRACT

A safe rear light bulb socket structure used in outdoor decorative light bulb series, which is an improvement made on a prior art socket. The improvement comprised a notch formed on one side of the socket, an overflow connected to the interior, a flange disposed on the opposite inner side, a raised block arranged on the top cover and having an insertion hole formed thereon. The electrical wire is secured by the top cover with the end extending into the insertion hole to get a safe protection. Water in the interior of the socket can be exhausted via the overflow to avoid a potential short-circuit.

1 Claim, 4 Drawing Sheets

SAFE SOCKET STRUCTURE USED FOR MINIATURE LIGHT BULBS

BACKGROUND OF THE INVENTION

Outdoor used C-type light bulb series consist of a plurality of miniature light bulb sockets connected by electrical wires and completed with a rear light bulb socket (1) at the end of the electrical wire. The socket (1) has a groove (11) as shown in FIGS. 1 to 3. An electrical wire (2) extends into the socket (1) with its bent end further extending into the groove (11). A cover (3) is placed on the top of the socket to secure the electrical wire in position. The major disadvantage of the conventional structure is the lack of drainage means in the closed space defined by the wall of the socket (1) and the light bulb (4). Because rain water may penetrate into the interior of the socket when the light bulb socket is used outdoors, excessive water may lead to short-circuit, resulting in the damage of the light bulb series. Thus it is desirable to have an improvement made on the conventional structure.

In view of the above problem, the present invention is to provide a safe rear bulb socket structure used for a C-type light bulb series, in which the conventional disadvantage has been eliminated. Now the features and benefits of the invention will be described below in more detail with reference to the accompanying drawings.

BRIEF DESCRIPTION OF ACCOMPANYING DRAWINGS

DETAILED DESCRIPTION OF PREFERRED EMBODIMENTS

Figure 1:
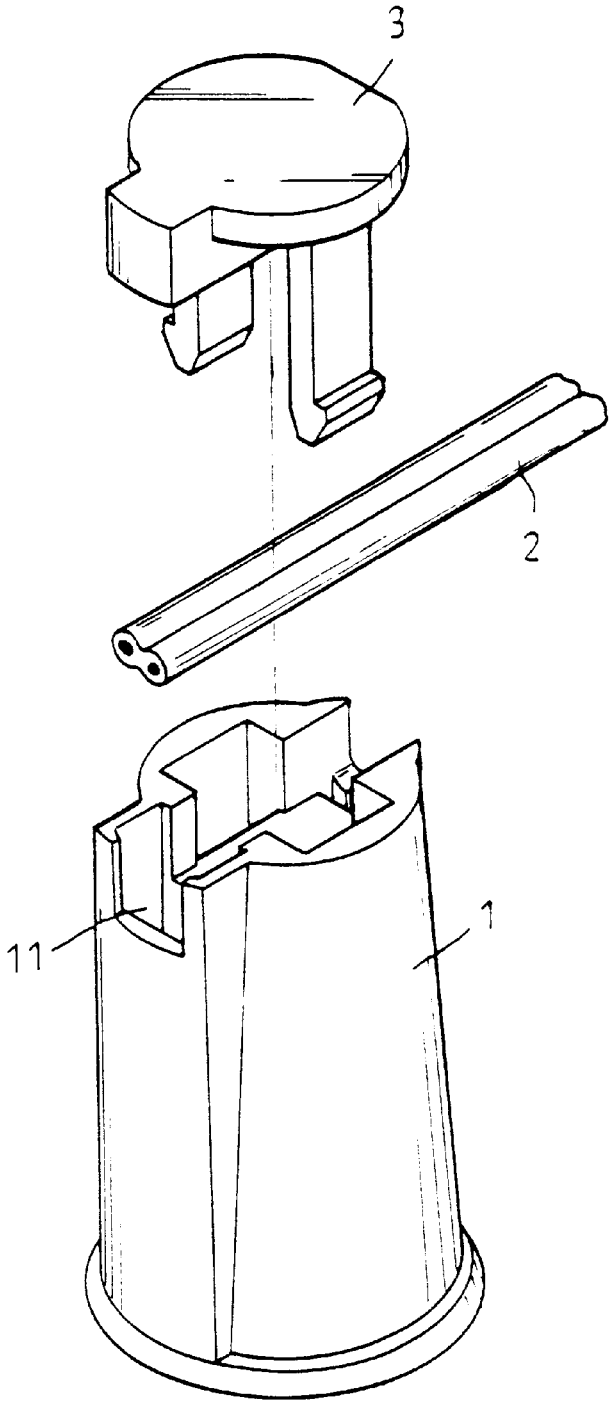
FIG. 1 (prior art)
FIG. 1 is an exploded view showing a conventional light bulb socket.
Figure 2:
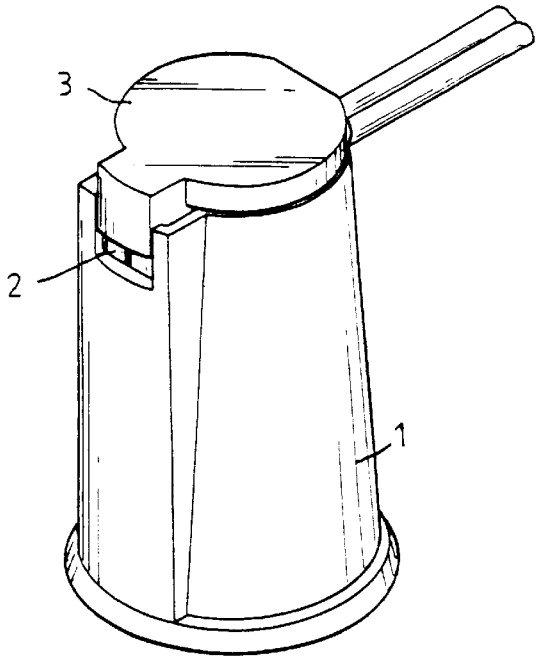
FIG. 2 (prior art)
FIG. 2 is a perspective view of the light bulb socket of FIG. 1.
Figure 3:
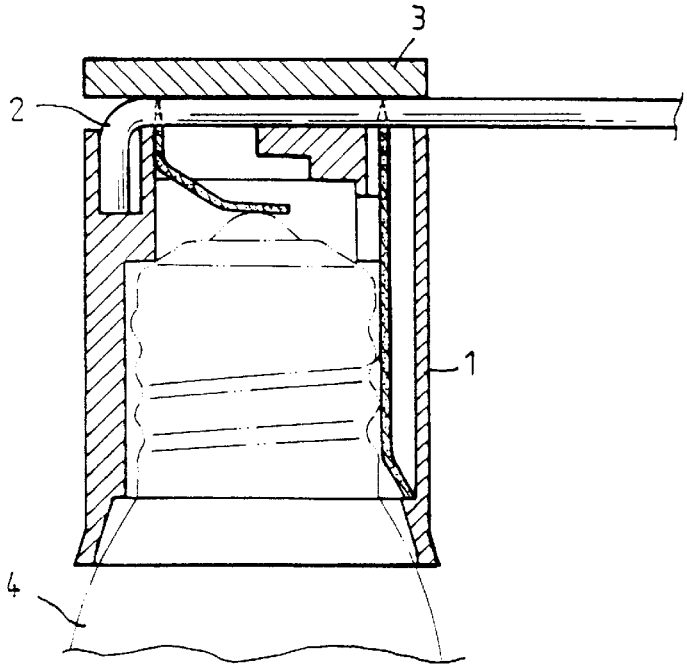
FIG. 3 (prior art)
FIG. 3 is a cross sectional view of the light bulb of FIG. 2.
Figure 4:
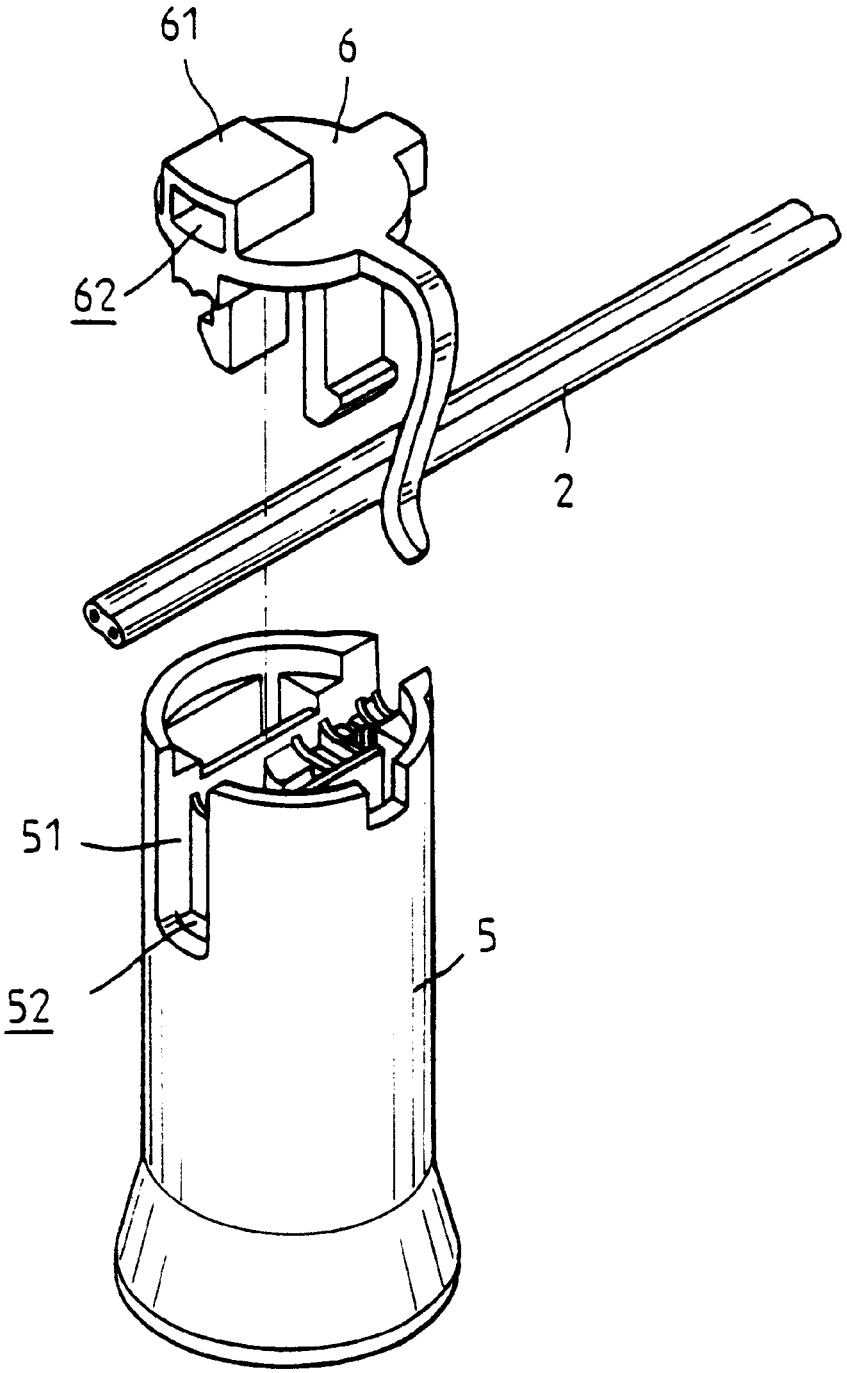
FIG. 4 is an exploded view showing an embodiment of the light bulb socket according to the invention.
Figure 5:
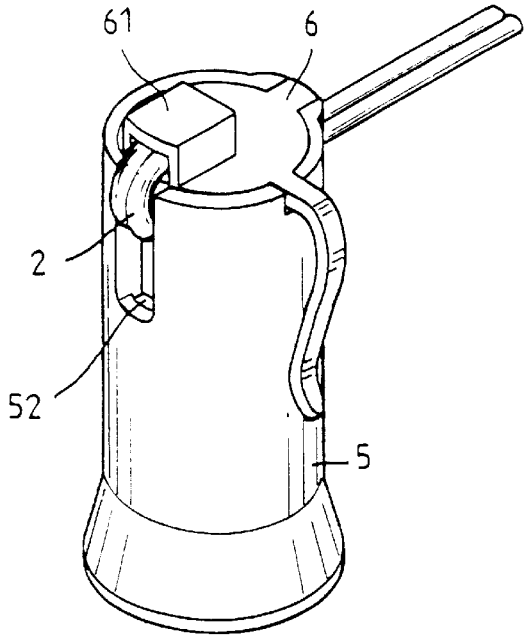
FIG. 5 is a perspective view of the light bulb socket of FIG. 4 in an assembled state.
Figure 6:
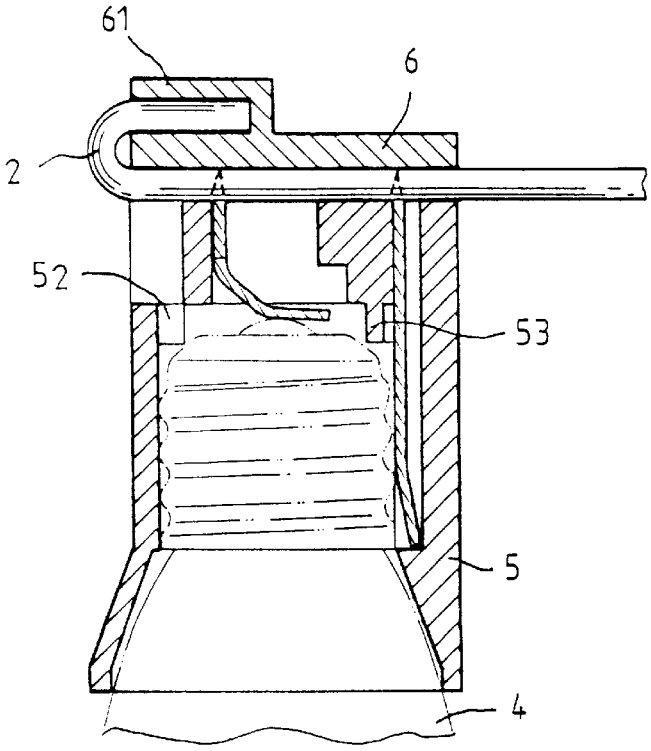
FIG. 6 is a cross sectional plan view of the light bulb socket of FIG. 5.

Referring to FIGS. 4 to 6, the present invention is primarily an improvement made on a prior art C type light bulb series, which includes a light bulb socket (5) and a top cover (6). The light bulb socket (5) is provided at one side with a notch (51) and an overflow (52) connected to the interior of the socket (5). In the corresponding position on the opposite side of the socket (5) there is formed a flange (53). Provided on the top cover (6) is a raised block (61) that has an insertion hole (62). The electrical wire (2) is secured by the top cover (6) with the end thereof extending into the insertion hole (62).

With this arrangement, the interior of the socket has an opening communicating to the outside after a light bulb (4) is seated on the socket (5). If rain water gets into the interior of the socket, it can be exhausted via the overflow (52) without running over the raised block (61) to get in touch with the positive and negative conductor plates of the socket simultaneously. Thus the invention can prevent the socket from short-circuit.

From the above description, evidently the invention can reach its goal of eliminating the potential safe problem of a conventional rear light bulb socket. Hence, we hereby apply a patent grant.

What is claimed is:

1. In a light bulb socket assembly, including a socket body having an interior portion circumscribed by a side wall, a top cover removably attached to an upper end of said side wall of said socket body, an electrical wire passing between said socket body and said top cover, and first and second contact plates within said interior of said socket body adapted for electrical contact with a light bulb, wherein the improvement comprises:

(a) a raised block secured to an outside surface of said top cover, said raised block having an insertion hole formed in a respective side thereof and adapted to receive and electrically isolate an end of said electrical wire therein, said electrical wire passing between said top cover and said socket body with a portion extending therefrom being bent so that said end thereof terminates within said insertion hole of said raised block to thereby prevent said end from direct contact with said interior of said socket body;

(b) a notch formed at said top end of said side wall of said socket body;

(c) an overflow passage extending downwardly from said notch into said interior of said socket body, said overflow passage providing a fluid communication path from said interior of said socket body to provide a drain path for water; and (d) a flange extending within said interior of said socket body and adapted to separate said interior into a first contact plate compartment and a second contact plate compartment to thereby prevent a short-circuit by preventing fluid communication therebetween.

* * * * *